US007987622B2

(12) United States Patent
Pitt et al.

(10) Patent No.: US 7,987,622 B2
(45) Date of Patent: Aug. 2, 2011

(54) METHOD AND APPARATUS FOR INSTALLING AN ADVERTISING SIGN

(75) Inventors: John Dunlop Pitt, Glasgow (GB); Matthew Macindoe, Glasgow (GB); Alan Suttie, Glasgow (GB)

(73) Assignee: Tiffin Metal Products Co., Tiffin, OH (US)

( * ) Notice: Subject to any disclaimer, the term of this patent is extended or adjusted under 35 U.S.C. 154(b) by 363 days.

(21) Appl. No.: 12/157,816

(22) Filed: Jun. 13, 2008

(65) Prior Publication Data

US 2009/0206228 A1 Aug. 20, 2009

(30) Foreign Application Priority Data

Feb. 19, 2008 (GB) ..... 0802982.9
Apr. 22, 2008 (GB) ..... 0807303.3

(51) Int. Cl.
*G09F 7/00* (2006.01)

(52) U.S. Cl. ..... 40/603; 40/601

(58) Field of Classification Search ..... 40/601, 40/603

See application file for complete search history.

(56) References Cited

U.S. PATENT DOCUMENTS

| | | | | |
|---|---|---|---|---|
| 3,673,720 | A * | 7/1972 | Thornton | 40/601 |
| 5,613,314 | A * | 3/1997 | Leverenz et al. | 40/610 |
| 5,791,390 | A * | 8/1998 | Watanabe | 160/84.03 |
| 6,055,754 | A * | 5/2000 | Melhuus | 40/601 |
| 6,826,861 | B2 * | 12/2004 | Alexander et al. | 40/601 |
| 2005/0188571 | A1 * | 9/2005 | Wilson | 40/601 |
| 2008/0148613 | A1 * | 6/2008 | Lefebvre | 40/601 |

FOREIGN PATENT DOCUMENTS

| | | |
|---|---|---|
| DE | 299 11 708 | 8/1999 |
| DE | 201 17 928 | 2/2002 |
| EP | 0 981 126 | 2/2000 |
| EP | 1 408 477 | 3/2007 |
| NL | 9 200 994 | 1/1994 |
| WO | WO 85/02890 | 7/1985 |
| WO | WO 88/03231 | 5/1988 |
| WO | WO 99/48077 | 9/1999 |
| WO | WO 2006/010168 | 1/2006 |
| WO | WO 2006/133484 | 12/2006 |

* cited by examiner

*Primary Examiner* — Casandra Davis
(74) *Attorney, Agent, or Firm* — Marshall & Melhorn LLC

(57) ABSTRACT

An apparatus for installing an advertising sign is disclosed. The apparatus comprises a support structure; a lifting system fixed to the support structure; a top rail supported on the lifting system such that the top rail can be raised and lowered between a lowered mounting position and a raised display position; and a bottom rail fixed to the support structure. The lifting system comprises a cord operable to raise the top rail to the upper display position. The top rail comprises a longitudinally extending channel adapted to engage a top periphery of an advertising sign, and the bottom rail comprises a longitudinally extending channel adapted to engage a bottom periphery of an advertising sign. A method for installing an advertising sign is also disclosed. A system and a method of retaining a flexible sheet are also disclosed.

28 Claims, 8 Drawing Sheets

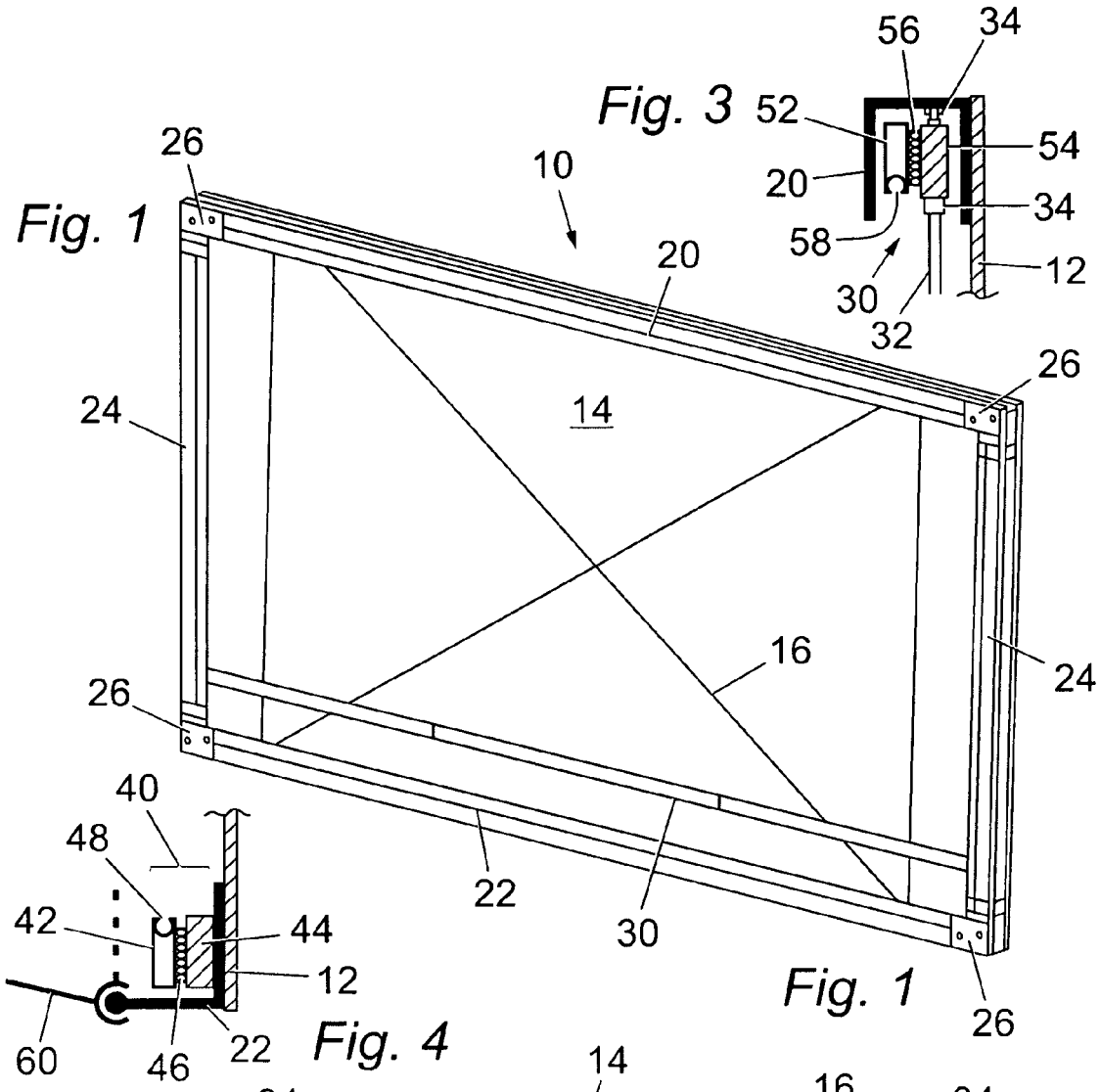
Fig. 1
10
14
16
20
22
24
26
30
Fig. 1
Fig. 3
52
54
56
34
20
58
30
32
12
40
48
42
44
12
60
46
22
Fig. 4
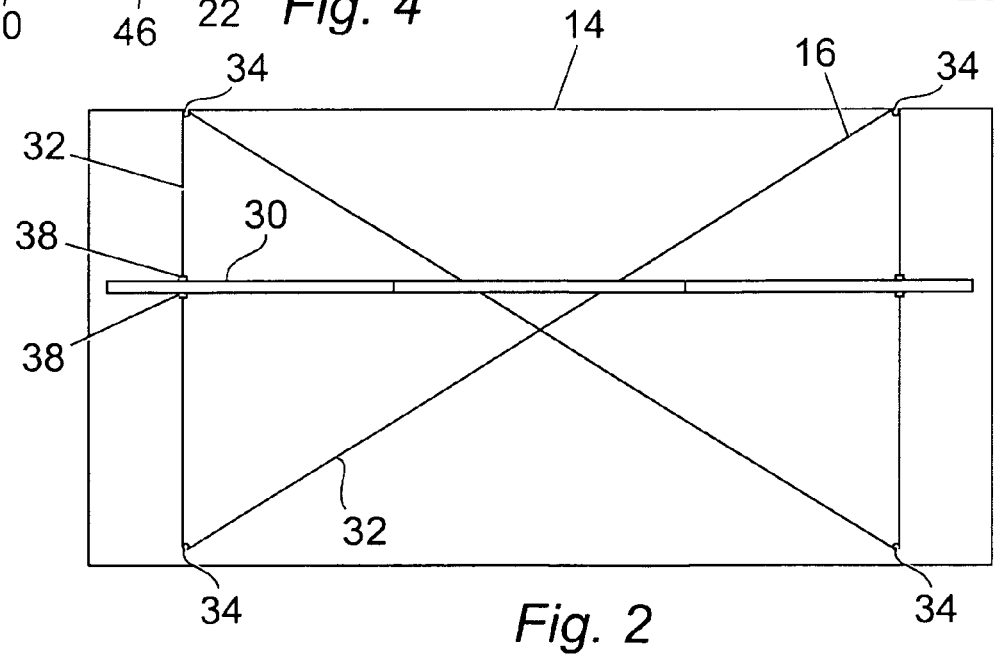
14
16
34
32
30
38
Fig. 2

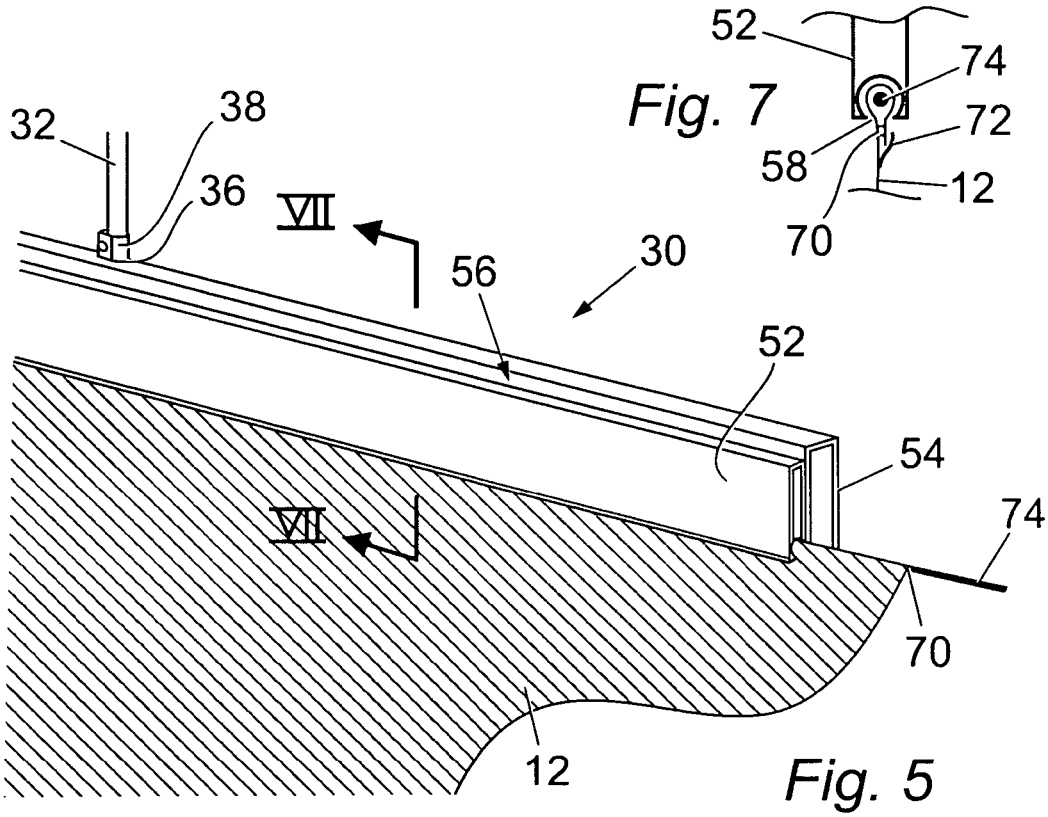
Fig. 7
Fig. 5
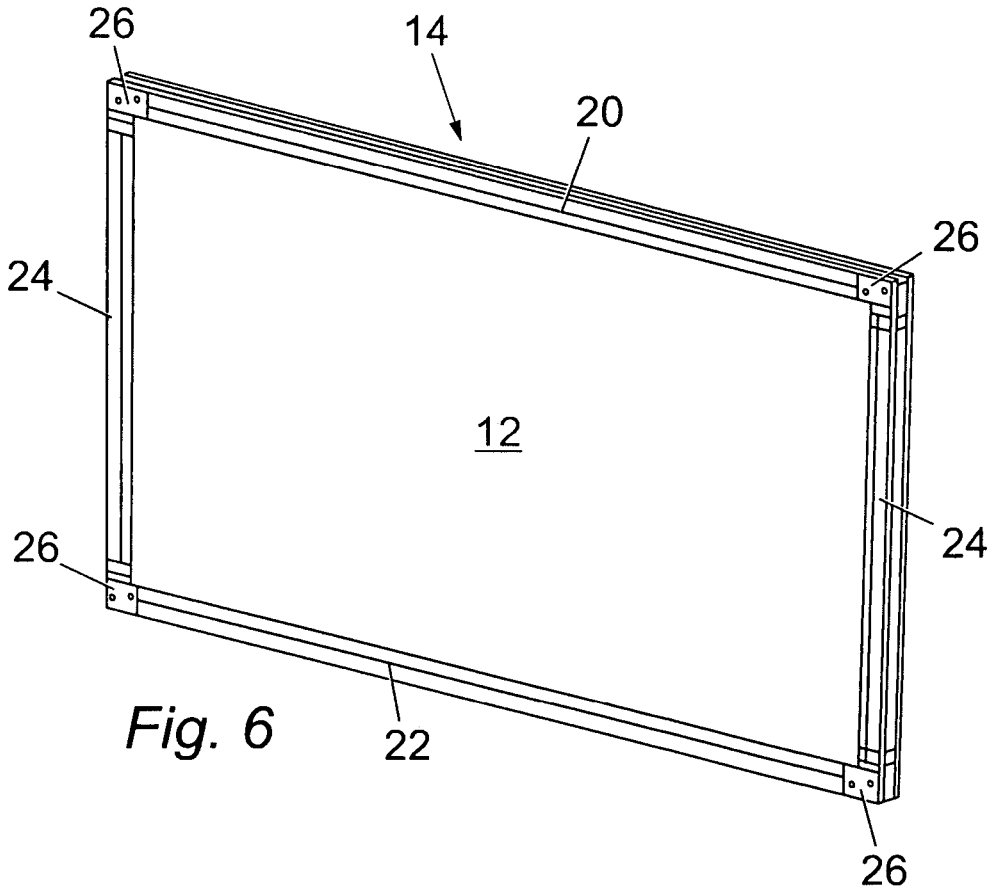
Fig. 6

METHOD AND APPARATUS FOR INSTALLING AN ADVERTISING SIGN

The present invention relates to a method and apparatus for installing an advertising sign on a background, in particular for installing a large sign or banner on a static site, such as a building, or an advertising hoarding, such as those seen by road sides.

Conventional roadside signs or advertisements comprise a number of sheets, which are glued together in sequence on a billboard. For different billboards, different numbers of sheets are used, but these typically range from six sheets to ninety-six sheets; a ninety-six sheet panel is typically 13 meters in horizontal width.

Such signs are inconvenient and time-consuming to install, and require one or more persons with ladders (the top of the billboard may be 6 meters high, for example). Also, when the sign needs to be changed, the original sign either has to be removed, or a new sign glued over it. When the old sign is removed, as it is covered in glue, it cannot be easily or fully recycled.

One possible alternative to gluing the sign to the billboard includes first making the sign, and then "finishing" it such that it can be attached to a frame mounted on the billboard. One way of doing this is to add edge strips to all four edges of the sign. The edge strips can include cylindrical protrusions, which can then be threaded into corresponding recesses in the frame, which is mounted on the billboard. This means that the sign can be installed on the billboard more easily, and also taken down, when it is needed to be replaced. However, this system requires both the sign to be specially "finished" at the creation stage by adding the edge strip, and the mounting requires people on ladders, so that they can be elevated to the height of the top of the billboard, in order to thread the protrusion into the frame. Furthermore, an old sign cannot be easily or completely recycled, because the edge strip would first have to be removed.

According to a first aspect of the present invention there is provided an apparatus for installing an advertising sign comprising:

- a support structure;
- a lifting system fixed to the support structure;
- a top rail supported on the lifting system such that the top rail can be raised and lowered between a lowered mounting position and a raised display position; and
- a bottom rail fixed to the support structure;
- wherein the lifting system comprises a cord operable to raise the top rail to the upper display position;
- wherein the top rail comprises a longitudinally extending channel adapted to engage a top periphery of an advertising sign; and
- wherein the bottom rail comprises a longitudinally extending channel adapted to engage a bottom periphery of an advertising sign.

The bottom rail may comprise a bottom support member fixed to the support structure and a bottom channel member which comprises the longitudinally extending channel adapted to engage the bottom periphery of an advertising sign, wherein the bottom channel member is releasably attached to the bottom support member by a mutual engagement system. The mutual engagement system may comprise mutually engaging mushroom fasteners provided on each of the bottom support member and the bottom channel member.

The top rail may comprise a top support member supported on the lifting system and a top channel member which comprises the longitudinally extending channel adapted to engage the top periphery of an advertising sign, wherein the top channel member is releasably attached to the top support member by a mutual engagement system. The mutual engagement system may comprise mutually engaging mushroom fasteners provided on each of the top support member and the top channel member.

The apparatus may comprise a longitudinally extending insert member releasably engageable within the longitudinally extending channel on the top and/or bottom rails.

In a first embodiment of the invention, the insert member forms part of the top and/or bottom periphery of an advertising sign to be installed.

In an alternative embodiment of the invention, the insert member is independent of an advertising sign to be installed and is adapted such that, upon its insertion into the channel, it releasably engages with the channel.

The channel and the insert member are respectively provided with inter-engageable formations adapted such that the insert member is releasably engageable within the channel by means of a snap-fit arrangement. The shape and/or dimensions of the insert member and/or the material from which it is formed may be selected such that the insert member is relatively more resiliently deformable than the channel to facilitate the snap-fit arrangement.

A plurality of inserts members may be attached to each channel in pre-insertion positions. The insert members may be provided in a variety of lengths.

The channel may be generally U-shaped in cross-section and comprise two side walls which together define a channel opening, wherein one of the side walls is provided with a detent extending inwardly into the channel opening in a direction towards the other side wall. The detent may extend continuously along the full length of the side wall of the channel. Alternatively, a plurality of discrete detents may be distributed along the full length of the side wall of the channel.

The longitudinally extending insert member may be generally U-shaped in cross-section and also comprise two side walls, one of which is inclined relative to the other. The inclined side wall may be provided with an outwardly extending barb adapted to engage behind the inwardly extending detent of the channel. The barb may extend continuously along the full length of the inclined side wall of the insert member. Alternatively, a plurality of discrete barbs may be distributed along the full length of the inclined side wall of the insert member.

The lifting system may comprise a parallel linkage mechanism which holds the top rail in a horizontal position during raising and lowering.

The lifting system may comprise one or more cords supported by sliding supports and/or rollers mounted on the support structure.

In one embodiment of the invention, the lifting system may comprise two cords fixed to the top rail at or near each end of the top rail. Each cord may extend from the top rail to the top of the support structure and down one side of the support structure, such that pulling the cords downwards at the side of the structure causes the top rail to be raised.

In an alternative embodiment of the invention, the lifting system may comprise a cord arranged in a continuous loop and supported by sliding supports and/or rollers mounted on the support structure. The cord may be fixed to the top rail at or near each end of the top rail. The cord may be arranged in a sideways figure of eight arrangement on the support structure, such that raising the cord at one side of the support structure causes the cord to be raised at the other side of the support structure.

The lifting system of either embodiment may further include a counterweight adapted to move downwards as the top rail is raised.

Alternatively or additionally, the top rail may be spring biased towards its raised display position.

The lifting system may further include a fastening means to fasten the cord so as to hold the top rail in the raised display position. The fastening means may be a cleat or clamp. The fastening means may be a projection about which the cord may be looped or tied.

In a further alternative embodiment of the invention, the lifting system may comprise two cords fixed to the top rail at or near each end of the top rail, each extending from the top rail to the top of the support structure, through a double pulley block, and down one side of the support structure (and optionally fixed to a common counterweight).

The apparatus may further include top and bottom frame members adapted to at least partially conceal the top rail and/or bottom rail when the top rail is in the raised display position.

The apparatus may further include side frame members adapted to at least partially conceal the lateral edge of an advertising sign when the top rail is in the raised display position.

The apparatus may further include side guide rails to which the sign may be connected by guide members or clips. The guide rails may comprise tracks with which to engage guide members or clips fixed to the lateral edges of the sign. The guide rails may comprise rods around which guide members or clips fixed to the lateral edges of the sign extend.

The bottom frame member may include a hinged or removable cover which opens to provide access to the bottom rail. The apparatus may include locking means to prevent unauthorised opening of the hinged or removable cover. The locking means may be in the form of lockable cover plates or the like.

One or more of the side frame members may include a hinged or removable cover which opens to provide access to the rear of the advertising sign, for example when operating the cord of the lifting system. The apparatus may include locking means to prevent unauthorised opening of the hinged or removable cover.

According to a second aspect of the present invention there is provided a system for installing an advertising sign comprising an apparatus according to the first aspect and an advertising sign.

The advertising sign may comprise a sheet of printable material, for example polyethylene although any suitable sheet material may be used. Preferably the material is recyclable.

Optionally, the longitudinally extending channels of the top and/or bottom rails may be adapted to engage a flange provided on the periphery of an advertising sign.

The advertising sign may have longitudinally extending pockets provided on the top and bottom edges thereof. The pockets may be formed by folding and securing the edges of the advertising sign to form a hem. The edges may be secured by gluing, stitching, tack welding, applying adhesive tape or any other suitable means.

The system may further comprise a semi-rigid cord member which may be threaded into the pocket provided on the top edge of the advertising sign to form a top flange in the advertising sign. The system may further comprise a second semi-rigid cord member which may be threaded into the pocket provided on the bottom edge of the advertising sign to form a bottom flange in the advertising sign.

In alternative embodiments, the advertising sign requires no peripheral finishing to facilitate its engagement with the longitudinally extending channels of the top and/or bottom rails.

According to a third aspect of the present invention there is provided a method for installing an advertising sign comprising the steps of:

- providing a support structure;
- providing a lifting system fixed to the support structure;
- lowering a top rail supported on the lifting system on a support to a lowered mounting position;
- engaging a longitudinally extending channel of the top rail with a top periphery of an advertising sign;
- using the lifting system to raise the top rail to a raised display position;
- engaging a longitudinally extending channel of a bottom rail of the support structure with a bottom periphery of the advertising sign; and
- securing the bottom channel member to the support structure.

In one embodiment, the steps of engaging the longitudinally extending channels involves threading a semi-rigid cord member into a pocket provided on the top and/or bottom peripheral edges of the advertising sign to form respective top and bottom flanges in the advertising sign and then threading the top and bottom flanges into the longitudinally extending channels on the respective top and bottom rails.

The bottom flange may be threaded into the longitudinally extending channel provided on the bottom channel member by sliding the bottom channel member relative to the support structure while holding the bottom flange substantially still.

The bottom channel member may be secured to the support structure by attaching the bottom channel member to a bottom support member fixed to the support structure using a releasable mutual engagement system. The mutual engagement system may comprise mutually engaging mushroom fasteners provided on each of the bottom support member and the bottom channel member.

In an alternative embodiment, the step of engaging a longitudinally extending channel of the top rail with a top periphery of an advertising sign involves interposing an upper periphery of an advertising sign between a longitudinally extending channel on the top rail and a longitudinally extending insert member respectively, and then inserting the insert member within the channel to frictionally engage the upper periphery of the advertising sign between the channel and the insert member.

Similarly, in the alternative embodiment, the step of engaging a longitudinally extending channel of the bottom rail with a top periphery of an advertising sign involves interposing a lower periphery of the advertising sign between a longitudinally extending channel on the bottom rail and a longitudinally extending insert member respectively, and then inserting the insert member within the channel to frictionally engage the lower periphery of the advertising sign between the channel and the insert member.

In the alternative embodiment, the steps of inserting the insert member may involve first inserting an insert member in a substantially central position within the channel and progressively inserting it in stages in both directions towards the respective distal ends of the bottom channel member.

In the alternative embodiment, the steps of inserting the insert member may involve inserting a plurality of shorter insert members along the length of the respective longitudinally extending channels.

In the alternative embodiment, the step of progressively inserting the or each insert member in both directions towards the respective distal ends of the bottom channel member may involve progressively manually tensioning the sign prior to each insertion.

In both embodiments, the lifting system may hold the top rail in a horizontal position during raising of the top rail to a raised display position.

In both embodiments, the step of raising the top rail may comprise pulling on one or more cords supported by sliding supports and/or rollers mounted on the support structure. The cords may be fixed to the top rail at or near each end of the top rail. Each cord may extend from the top rail to the top of the support structure and down one side of the support structure, such that pulling the cords downwards at the side of the structure causes the top rail to be raised.

In both embodiments, the step of raising the top rail may comprise pulling on a cord arranged in a continuous loop and supported by sliding supports and/or rollers mounted on the support structure. The cord may be fixed to the top rail at or near each end of the top rail. The cord may be arranged in a sideways figure of eight arrangement on the support structure, such that raising the cord at one side of the support structure causes the cord to be raised at the other side of the support structure.

In both embodiments, the method may include the step of providing top and bottom frame members to at least partially conceal the top edge and bottom edge of the advertising sign when the top rail is in the raised display position.

In both embodiments, the method may include the step of providing side frame members to at least partially conceal the lateral edges of the advertising sign when the top rail is in the raised display position.

In both embodiments, the method may include the step of opening a hinged or removable cover to provide access to the bottom channel member and bottom support member.

In both embodiments, the method may include the step of opening a hinged or removable cover to provide access to the rear of the advertising sign to operate the lifting system.

In both embodiments, the method may include the step of connecting the lateral edges of the sign to guide rails provided at the edges of the support structure. The guide rails may comprise tracks with which guide members fixed to the lateral edges of the sign are engaged. The guide rails may comprise rods around which guide members fixed to the lateral edges of the sign are looped.

According to a fourth aspect of the present invention there is provided a method for retaining a flexible sheet comprising the steps of:

- providing a longitudinally extending channel provided with an inwardly extending detent;
- providing a longitudinally extending insert member provided with an outwardly extending barb;
- interposing a flexible sheet between the channel and insert member respectively; and
- releasably inserting the insert member within the channel such that the barb snaps into position behind the detent to frictionally engage the flexible sheet between the channel and the insert member.

The step of interposing a flexible sheet between a longitudinally extending channel and a longitudinally extending insert member may comprise interposing a peripheral region of the flexible sheet.

Embodiments of the invention will now be described, by way of example only, and with reference to the following drawings, in which:-

FIG. 1 shows a perspective view of a sign installation apparatus of the invention, before the sign is attached to the top rail;

FIG. 2 is a front elevation of the apparatus of FIG. 1, with the frame members removed;

FIG. 3 is a sectional view through the top frame member and top rail of the apparatus of FIG. 1 with the top rail in a raised display position;

FIG. 4 is a sectional view through the bottom frame member and bottom rail of the apparatus of FIG. 1, with the bottom channel member secured to the bottom support member;

FIG. 5 shows a partial perspective view of the top rail in an intermediate position with the sign attached;

FIG. 6 shows a perspective view of the apparatus of FIG. 1, with the sign attached to the top rail in the raised display position;

FIG. 7 is a partial sectional view on line VII-VII in FIG. 5;

Figure 8:
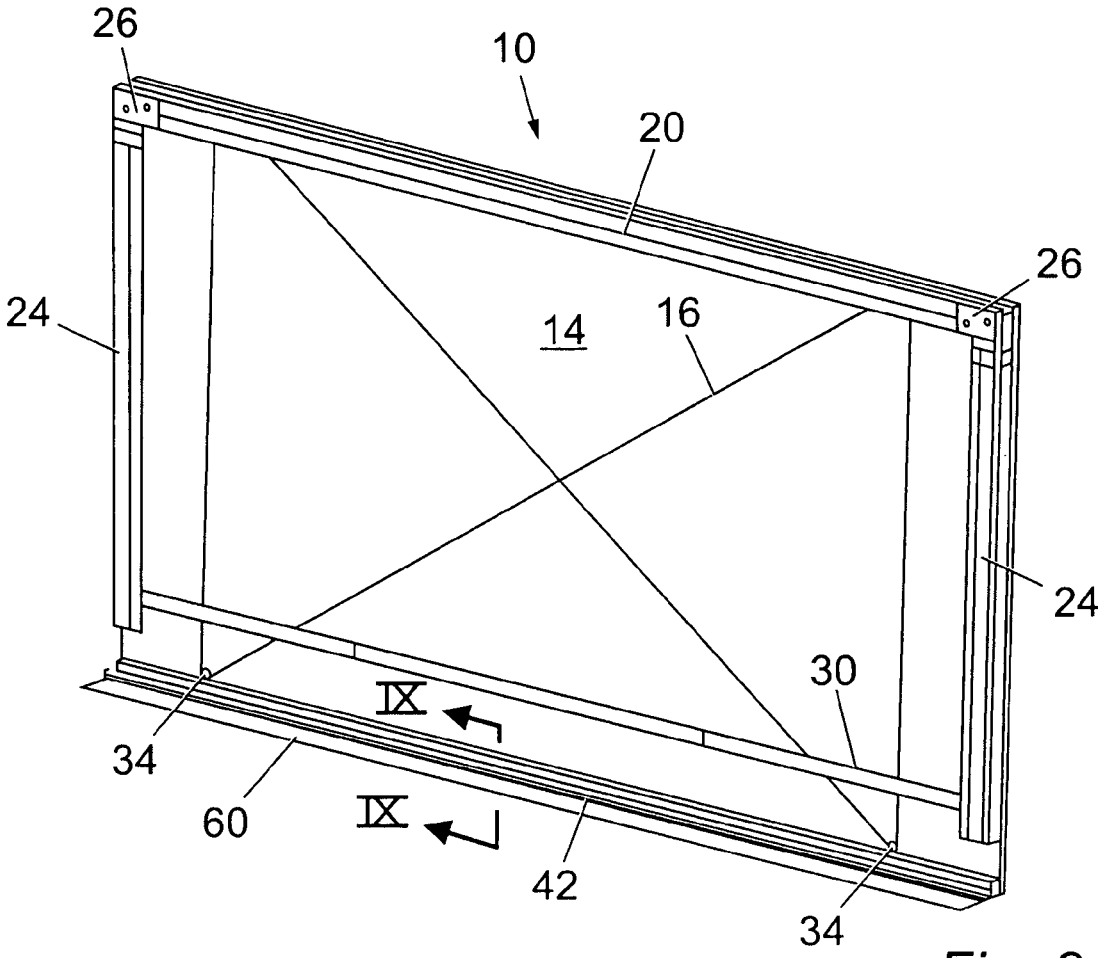
FIG. 8 shows a perspective view corresponding to that of FIG. 1, showing an alternative bottom frame member and bottom rail member, with the front panel of the bottom frame member folded down.

Referring now to FIGS. 1 and 6, a sign installation apparatus 10 for displaying an advertising sign 12 includes a support structure 14 on which is fixed a lifting system 16. The support structure 14 can be a board of any suitable material, such as plywood or MDF, mounted to an existing structure such as a building or wall, or it can be an independent structure, such as a billboard hoarding, a mobile trailer or the like. The support structure 14 functions as a billboard, to display an advertising sign 12, typically at the side of a road or railway, etc. Although the term "advertising sign" is used, the invention encompasses any sign. The sign may carry advertising material, but is not limited to an advertising use, and may carry information or decorative subject matter. The sign 12 is planar and rectangular and has width and height dimensions. The sign 12 consists of polyethylene, which is 100% recyclable, although other suitable materials can be used, such as paper or other plastic sheet material.

The apparatus includes a top frame member 20, a bottom frame member 22 and side frame members 24 which serve to conceal the peripheral edges of the advertising sign 12 when it is in the raised display position shown in FIG. 6. The side frame members 24 may include air vents to reduce the amount of flapping of the advertising sign during installation in windy conditions. The frame members 20, 22, 24 may be of uPVC, aluminium, alloy or any other suitable material, and preferably formed by extrusion. The frame members 20, 22, 24 are fixed to the support structure 14 by any suitable fastening means, such as bolts, screws, adhesive, nails or the like. Although they are shown as continuous members, they may be formed from separate components which are joined together. Cover plates 26 are provided at each corner to join the two frame members which meet at the corner.

The apparatus includes a substantially rigid top rail 30 supported on the lifting system 16 such that the top rail 30 can be raised and lowered between a lowered mounting position shown in FIG. 1 and a raised display position shown in FIG. 6. In the illustrated embodiment the lifting system is a parallel linkage mechanism which includes a cord 32 arranged in a continuous loop and supported by rollers 34 mounted on the support structure. The cord 32 is fixed to the top rail 30 at or near each end of the top rail 30. The fixing can be achieved by passing the cord 32 through an aperture 36 provided in the top rail 30 and securing clamps 38 immediately above and below the rail 30, as shown in FIG. 5, to prevent the cord 32 moving with respect to the rail 30. The cord 32 is arranged in a sideways figure of eight arrangement on the support structure 14, such that raising the vertical cord at one side of the support structure causes the diagonal lengths of cord to move down and the vertical cord at the other side of the support structure to be raised also. This ensures that the top rail 30 remains horizontal while the lifting system 16 is operated to raise it. Any suitable low friction support such as PTFE bearing surfaces may be used instead of rollers 34 to support the cord 32 at the corners.

The apparatus includes a bottom rail 40 fixed to the support structure 14. The bottom rail 40 is not visible in FIGS. 1 and 6 because it is concealed by the bottom frame 22, but it can be seen in FIG. 4. In the illustrated embodiment the bottom rail 40 comprises a bottom channel member 42 removably fastened to a bottom support member 44 fixed to the support structure 14. The bottom support member 44 may be omitted and the bottom channel member 42 may be removably fastened directly to the support structure 14.

The fastening means 46 with which the bottom channel member 42 is removably fastened is a mutual engagement system 46, for example mutually engaging mushroom fasteners provided on each of the bottom support member 44 or support structure 14 as appropriate and the bottom channel member 42, such as 3M DualLock™. The mutual engagement system 46 should allow the bottom channel member 42 to be secured to the support structure 14 by an operative when a sign 12 is mounted on the apparatus 10 and removed from the support structure 14 by an operative when a sign 12 is removed from the apparatus 10. Typically the mutual engagement system 46 is provided continuously or at intervals along the length of the bottom channel member 42.

In the illustrated embodiment the top rail 30 comprises a top channel member 52 removably fastened to a top support member 54, as best seen in FIGS. 3 and 5. The fastening means 56 with which the top channel member 52 is removably fastened is a mutual engagement system 56, for example mutually engaging mushroom fasteners provided on each of the top support member 54 and the top channel member 52, such as 3M DualLock™. The mutual engagement system 56 should allow the top channel member 52 to be secured to the top support member 54 by an operative when a sign 12 is mounted on the apparatus 10 and removed from the top support member 54 by an operative when a sign 12 is removed from the apparatus 10. Typically the mutual engagement system 56 is provided continuously or at intervals along the length of the top channel member 52.

The top rail 30 includes a longitudinally extending channel 58 in the top channel member 52 which is adapted to engage a top flange of an advertising sign 12, while the bottom rail 40 includes a longitudinally extending channel 48 in the bottom channel member 42 which is adapted to engage a bottom flange of an advertising sign 12.

As shown in FIG. 4, the bottom frame member 22 may include a hinged or removable cover 60 which opens to provide access to the bottom rail 40. The hinge is shown schematically in FIG. 4, and it is to be understood that any suitable hinge arrangement may be used. In practice the hinged cover 60 can be arranged to fold down through an angle just less than 90° to provide a working surface when in the folded down position. An operative can use the working surface to install the sign 12 in the channel 48 of the bottom rail 40, as will be explained below. The apparatus may include locking means (not shown) to prevent unauthorised opening of the hinged or removable cover. The locking means may be in the form of lockable cover plates or the like. For example a lock may be provided in the cover plates 26 at each end of the bottom frame member 22, which are arranged such that the hinged cover 60 cannot be folded down until the cover plates 26 are removed. Similar hinged or removable covers (not shown) may be provided on one or more of the side frame members 24 to provide access to the rear of the advertising sign 12, for example when operating the cord 32 of the lifting system 16. These may also include locking means.

Figure 9:
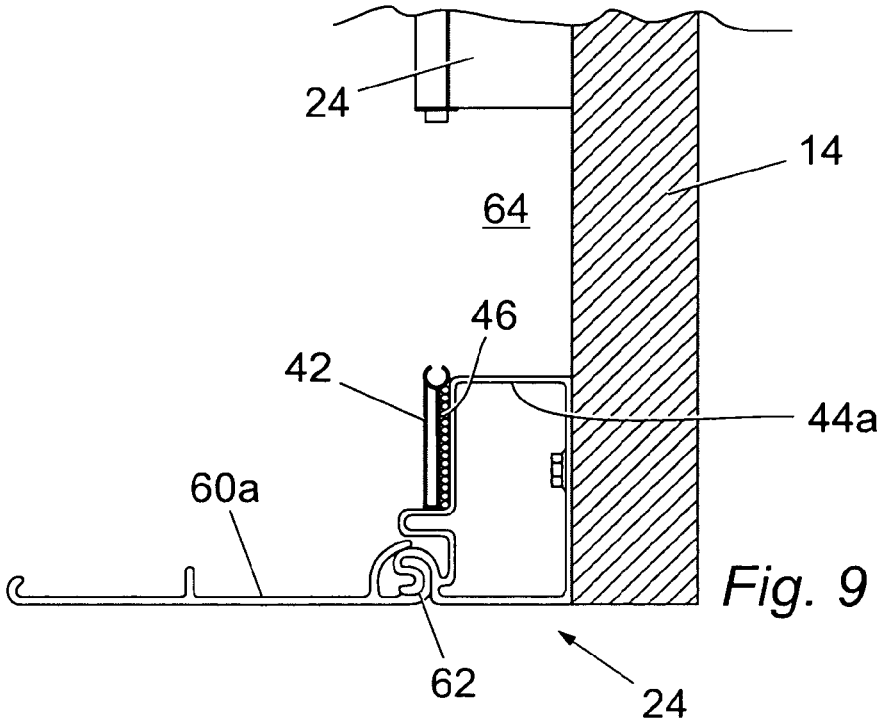
FIG. 9 is a partial sectional view on line IX-IX in FIG. 8.

A further example of a hinged cover **60*a* is shown in FIGS. 8 and 9. In this embodiment the bottom support member 44*a* also serves as part of the bottom frame 42 together with a hinged cover 60*a* connected to the bottom support member 44*a* by a hinge 62. Components similar to those in the embodiments previously described are indicated with the same reference numeral. It can be seen from FIG. 9 that the side frame member 24 can be stopped short of the bottom frame member 24. This allows access through the gap 64 to the cord 32 of the lifting system 16 to lower and raise the top rail 30. The gap also facilitates the threading of the bottom channel member 42 onto the bottom flange of the sign 12. The gap can be closed by a cover plate 26 after installation of the sign 12, as seen in FIG. 6**.

The advertising sign itself 12 is best seen in FIG. 5. It has longitudinally extending pockets 70 provided on its top and bottom peripheral edges. The pockets 70 are made by folding and securing the peripheral edges of the advertising sign 12 to form a hem, as shown in FIG. 7. The edges may be secured by gluing, stitching, tack welding, applying adhesive tape 72 or any other suitable means. The material used to secure the edges should preferably be compatible with the material of the advertising sign 12 so that the whole sign can be recycled after use. For example polyethylene tape 72 could be used with a polyethylene sign 12. It will be appreciated that the word peripheral is used to denote the region of the advertising sign 12 at its respective edges which is normally concealed from view behind frame members 20, 22 described above.

A semi-rigid cord member 74, for example of nylon or polypropylene, is threaded into the pockets provided on the top and bottom peripheral edges of the advertising sign 12 to form top and bottom flanges respectively in the advertising sign 12. The flanges can then be slid into the longitudinally extending channels 48, 58 in the bottom and top channel members 42, 52, where they are held by the narrow neck at the slot opening into the channel 48, 58.

Figure 10:
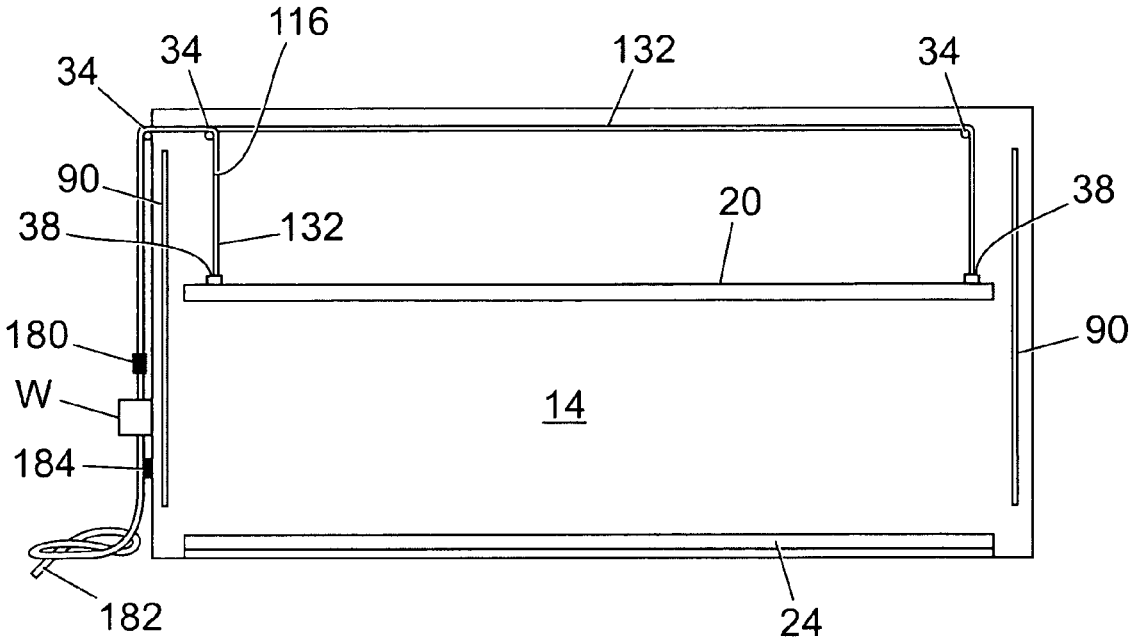
FIG. 10 is a front elevation of another embodiment of a sign installation apparatus of the invention, before the sign is attached to the top rail, with the frame members removed.

FIG. 10 shows a sign installation apparatus with an alternative lifting system 132. Other components of the apparatus are the same as those in the embodiment of FIGS. 1 and 2, and are not described further. The lifting system 116 comprises two cords 132 attached to the top rail 20 and passing over pulleys 34 to one side of the support structure. The cords 132 may be connected by a clamp 180, below which may be a single cord 182. The cord 182 may be connected to a counterweight W (shown schematically), which is adapted to move downwards as the top rail 20 is raised. The falling of the counterweight W provides some force to assist in the raising of the top rail 20. Alternatively the cords may continue below the clamp 180 as separate cords 132. A fastening means 184 is fixed to the support structure 14 for fastening the cord 132, 182 so as to hold the top rail 20 in the raised display position. The fastening means 184 may be a cleat, clamp or projection about which the cord 132, 182 may be looped or tied. After installation of the sign, the cord 132, 182 is hidden by the side frame member 24 and lockable cover panel 26. Guide rails 90 are provided at each side of the support structure 14 to guide and hold the lateral edges of the sign 12.

Figure 11:
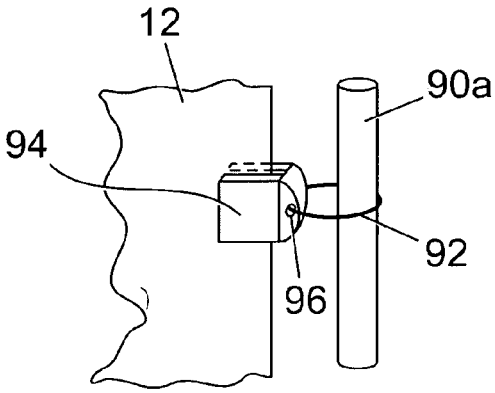
FIGS. 11 and 12 are partial views of alternative embodiments of guide rails and guide members which secure the edges of the sign in the apparatus of FIG. 10.
Figure 12:
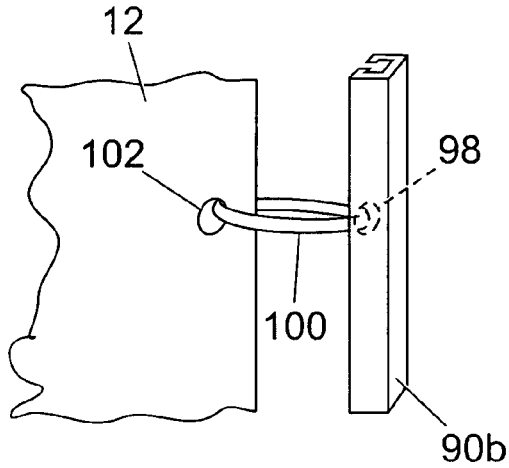

FIGS. 11 and 12 show alternative embodiments of the guide rail 90. In FIG. 11 the guide rail 90*a* is a rod about which a guide member 92 in the form of a loop or ring passes. A moulded plastic clamping member 94 is clamped to the edge of the sign 12, and the loop or ring 92 passes through an eye 96 in the clamping member 94. In FIG. 12 the guide rail 90*b* is a rail with which a corresponding shaped head 98 of a guide member 100 engages. The guide member passes through an aperture 102 formed in the edge of the sign 12.

The guide members 92, 100 can be threaded onto the guide rails 90 when the sign is laid along the bottom of the apparatus 10. Typically three or four guide members can be provided on each side of the sign. The lower edges of the guide rails are provided above the bottom rail 24 to make this possible. If necessary the guide rails 90 can be pulled away from their lower support to allow the guide members 92, 100 to be threaded on before refixing the guide rails 90. As the top rail 20 and sign 12 are raised, the guide members 92, 100 slide up the guide rails 90 and hold the edges of the sign to the guide rails 90.

FIGS. 13-16 show a further alternative embodiment of the invention whereby the substantially rigid top rail (not shown) comprises a top longitudinally extending channel member 252 including a longitudinally extending channel opening 258. The channel member 252 may be fixed to the top rail or it may itself act as the top rail. The channel opening 258 is generally U-shaped and symmetrical in cross-section and is defined by a generally planar base wall 252*a* and two opposing generally planar side walls 252*b*, 252*c* each extending substantially perpendicularly from the base wall 252*a*. An inwardly projecting detent 270 is provided on one side wall 252*b* and projects into the channel opening 258 towards the opposing side wall 252*c* from a position remote from the base wall 252*a*. The detent 270 therefore serves to narrow the entry of the channel opening 258.

The detent 270 is provided with an inclined surface 270*a* which facilitates the insertion of a longitudinally extending insert member 300 into the channel opening 258 as described further below. The insert member 300 is also generally U-shaped in cross-section and is provided with two side walls 352*b*, 352*c*. One of the side walls 352*b* is provided with a ramp surface 352*d* which is inclined relative to the other side wall 352*c*. The respective side walls 352*b*, 352*c* converge at a position which is offset towards the side wall 352*c* such that the insert member 300 is asymmetric in cross-section.

The ramp portion 352*d* of side wall 352*b* terminates an outwardly extending barb 352*e* the function of which is described below. Outwardly directed sign engaging flanges 360*a*, 360*b* are provided at the distal ends of each side wall 352*b*, 352*c*. The barb 352*e* and flange 360*a* define a recessed portion 370 which is dimensioned to accommodate the detent 270 of the channel member 252 as described below.

Figure 13:
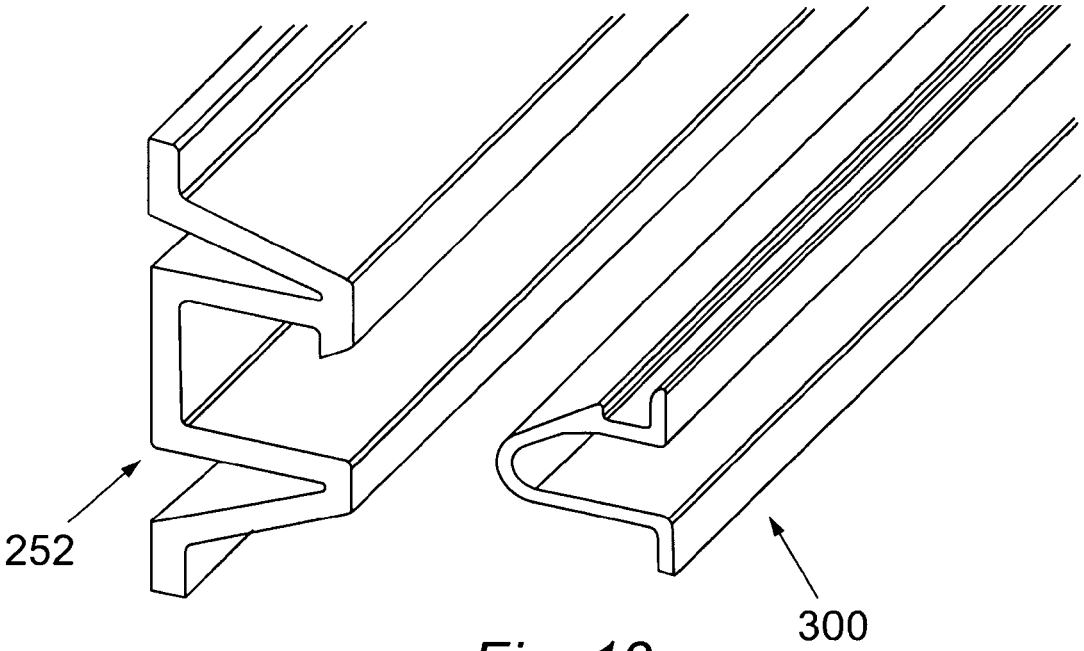
FIG. 13 shows a partial perspective view of a longitudinally extending top channel and a longitudinally extending insert member according to a further alternative embodiment of the invention.
Figure 14:
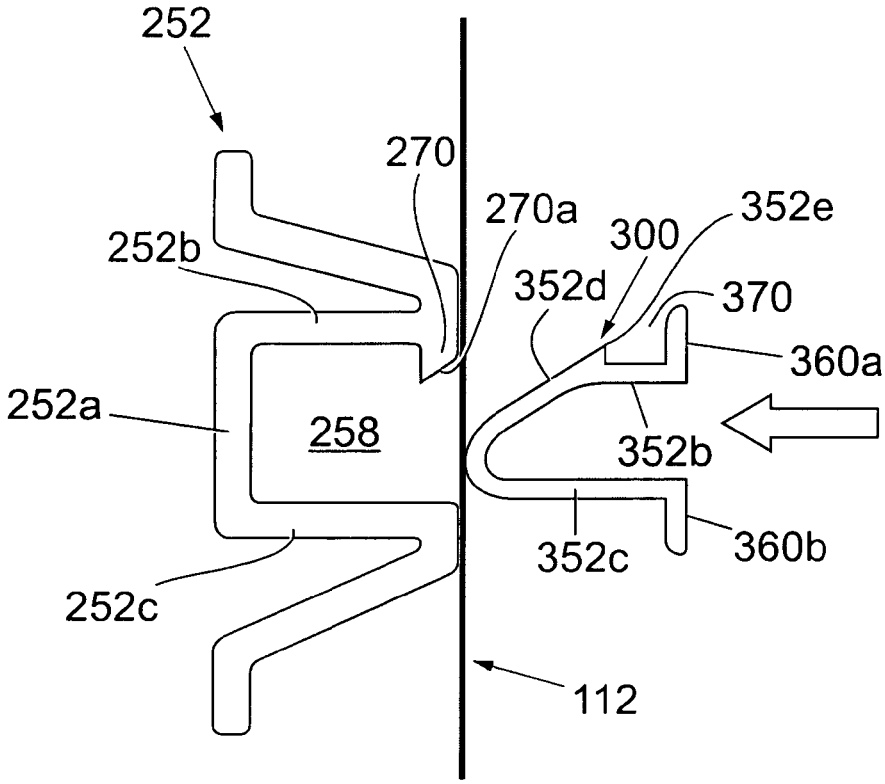
FIG. 14 shows a sectional view of the longitudinally extending top channel and the longitudinally extending insert member of FIG. 13, with an advertising sign interposed between the two prior to the engagement of the insert member within the channel.
Figure 15:
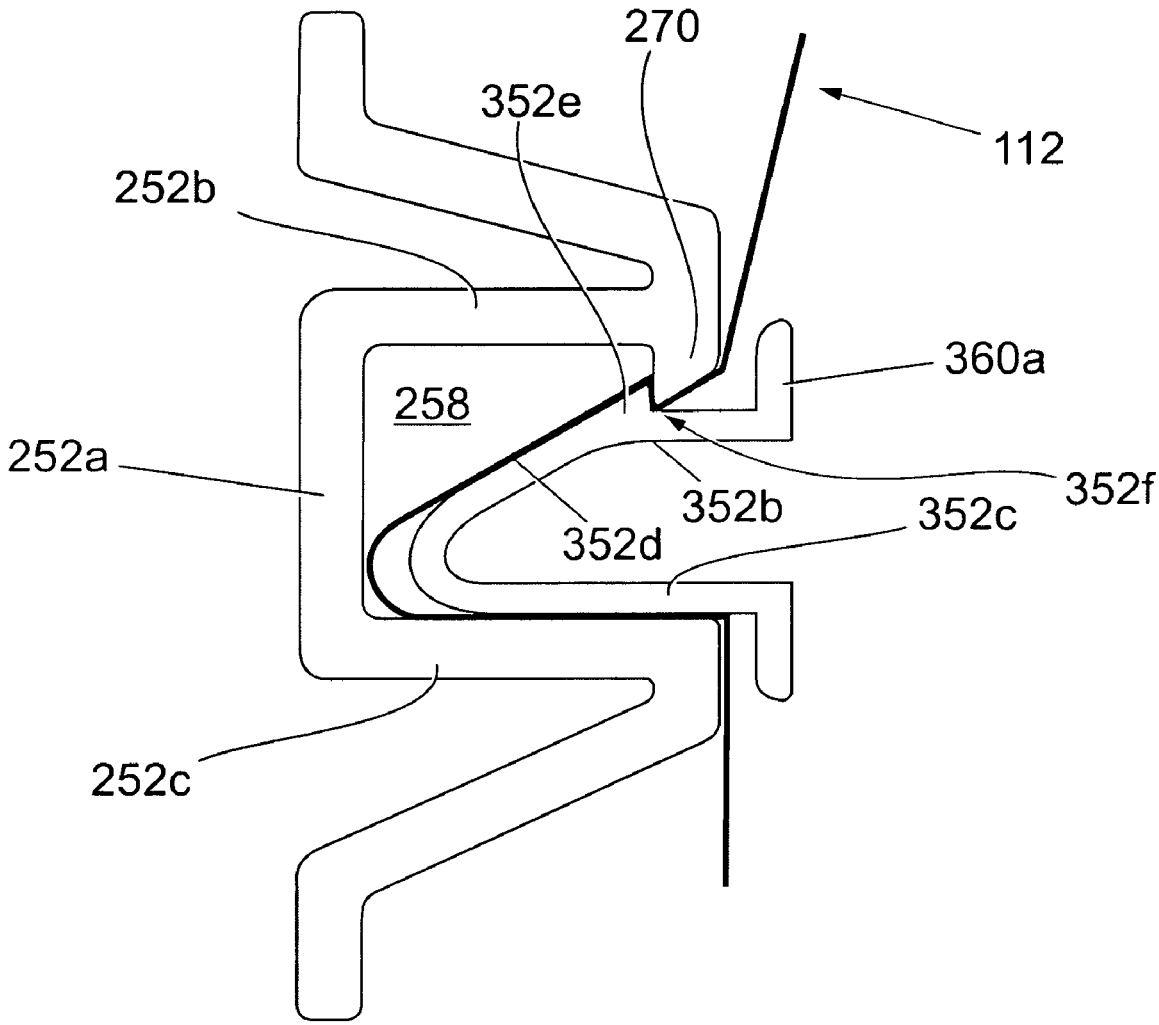
FIG. 15 shows a sectional view of the longitudinally extending top channel and the longitudinally extending insert member of FIG. 13, with an advertising sign frictionally engaged between the insert member and the channel.

The inwardly projecting detent 270 and the outwardly extending barb 352*e* are on the uppermost sides of the top channel member 252 and the insert 300 respectively, as shown in FIGS. 13-15.

The top channel member 252 and its detent 270 are formed, preferably by extrusion, as one integral piece, together with the top rail. Optionally, the top channel member 252 is extruded into the top rail, such that it forms one of the sides of the top rail. The top rail and the top channel member 252 are typically both aluminium. However, it will be appreciated that other suitable materials may equally be employed, for example, uPVC or a different plastics material or alloy.

Similarly, the insert member 300 and its barb 352*e* are formed, preferably by extrusion, as one integral piece. The insert 300 typically comprises uPVC, typically of calcium zinc type. However, it will be appreciated that a different plastics material, aluminium, other metals, alloys or any other suitable materials may equally be employed.

During insertion of the insert member 300 into the channel opening 258 the ramp surface 352*d* engages the inclined surface 270*a* of the detent 270, the respective surfaces 352*d*, 270*a* facilitating a cam action. During insertion of the insert member 300 from the position shown in FIG. 14 towards the position shown in FIG. 15, the side wall 352*b* of the insert member 300 resiliently pivots towards its opposing side wall 352*c*. Once the barb 352*e* passes beyond the detent 270, the side wall 352*b* snaps back to its original position thereby positioning the barb 352*e* within the channel opening 258 behind the detent 270, the detent 270 being received in the recessed portion 370. The insert member 300 is thereby securely engaged within the channel opening 258.

Figure 16:
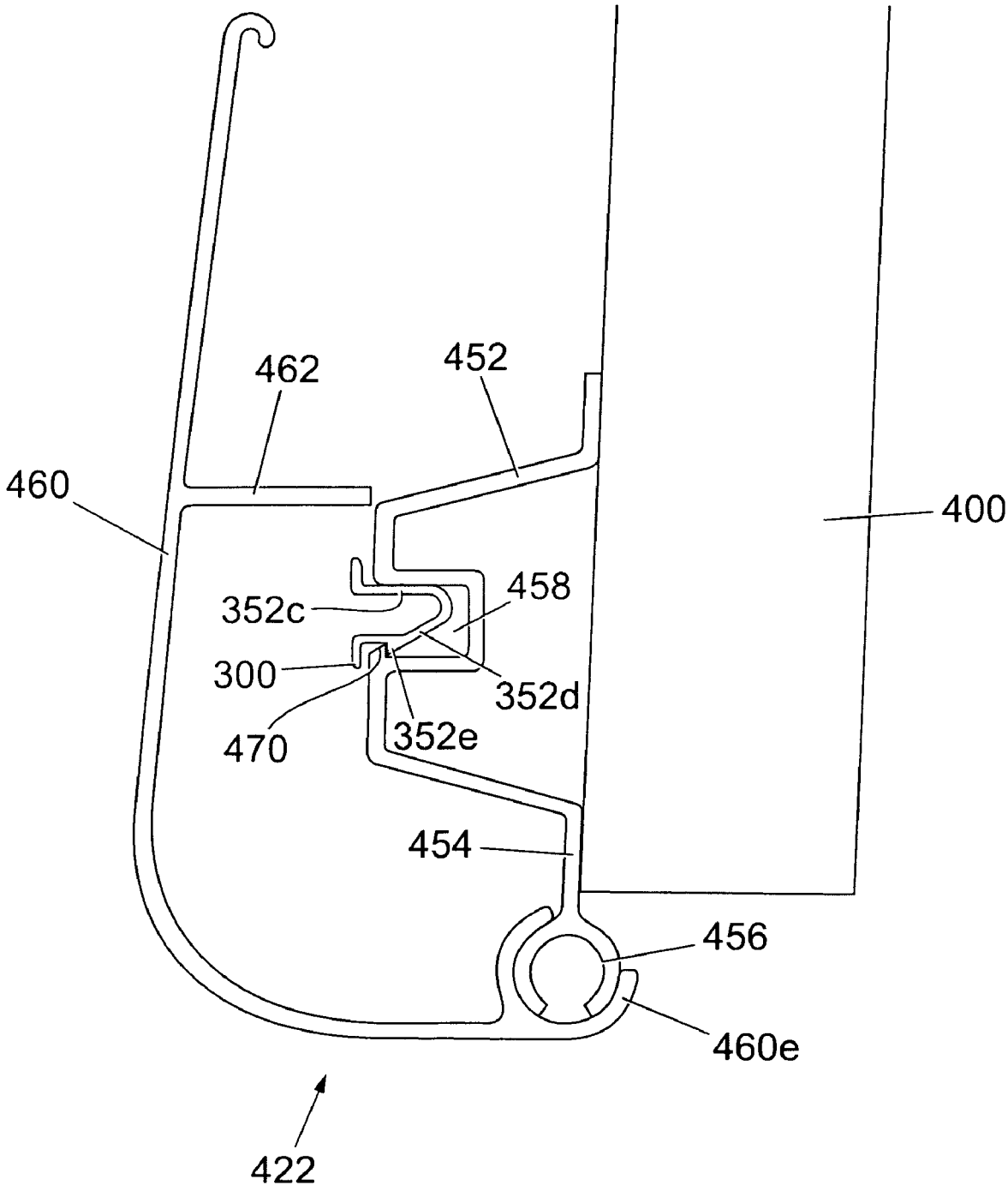
FIG. 16 shows a sectional view of a longitudinally extending bottom channel and a further longitudinally extending insert member according to the embodiment shown in FIGS. 13 to 15, the bottom channel being located on a billboard.

FIG. 16 shows an insert 300 and a bottom rail, which comprises a bottom channel member 452. The bottom channel member 452 and the insert 300 are shown in situ on a lower end of a billboard 400. The bottom channel member 452 is attached directly to the billboard 400, e.g. by bolts, screws, adhesive, nails or any other suitable fastening means.

The bottom channel member 452 may be of uPVC, a different plastics material, aluminium, alloy, or any other suitable material, and is preferably formed by extrusion. In this embodiment, the bottom channel member 452 is formed from uPVC, of the calcium zinc type. The bottom channel member 452 is very similar to the top channel member 252, and like parts have like reference numbers, which commence with "400". The insert 300 is the same as the insert 300 described with reference to FIGS. 13 to 15.

The bottom channel member 452 and the insert 300 are reversed in orientation, as compared to the top channel member 252 and insert 300 shown in FIGS. 13 to 15. That is, the inwardly projecting detent 470 and the outwardly extending barb 352*e* are on the lowermost sides of the bottom channel member 452 and the insert 300 respectively.

The bottom channel member 452 has a lower flange 454 which terminates in an elongate protrusion 456 of c-shaped cross-section. Engaged with (and rotatably mounted on) the elongate protrusion 456 is a correspondingly shaped end 460e of a hinged cover 460. The hinged cover 460 is elongate, with a substantially L-shaped cross-section. The hinged cover 460 is similar to the hinged cover 60*a* of FIGS. 8 and 9 and functions in a similar way.

In FIG. 16, the hinged cover 460 is in a closed position, in which it (together with part of the bottom channel member 452) substantially surrounds the channel opening 458. Specifically, a longitudinal rib 462 extends perpendicularly from the inner side of the hinged cover 460, and substantially meets the upper end of the bottom channel member 452. Thus, in the closed position, the channel opening 458 and insert 300 are not accessible (e.g. to vandals).

A lock (not shown) is provided such that the hinged cover 460 can be locked in the closed position. To open the hinged cover 460, it is unlocked, and the hinged cover 460 is rotated through about 90 degrees relative to the elongate protrusion 456, to provide access to the channel opening 458.

The bottom channel member 452 and the hinged cover 460 together form a bottom frame member 422 of the apparatus.

Figure 17:
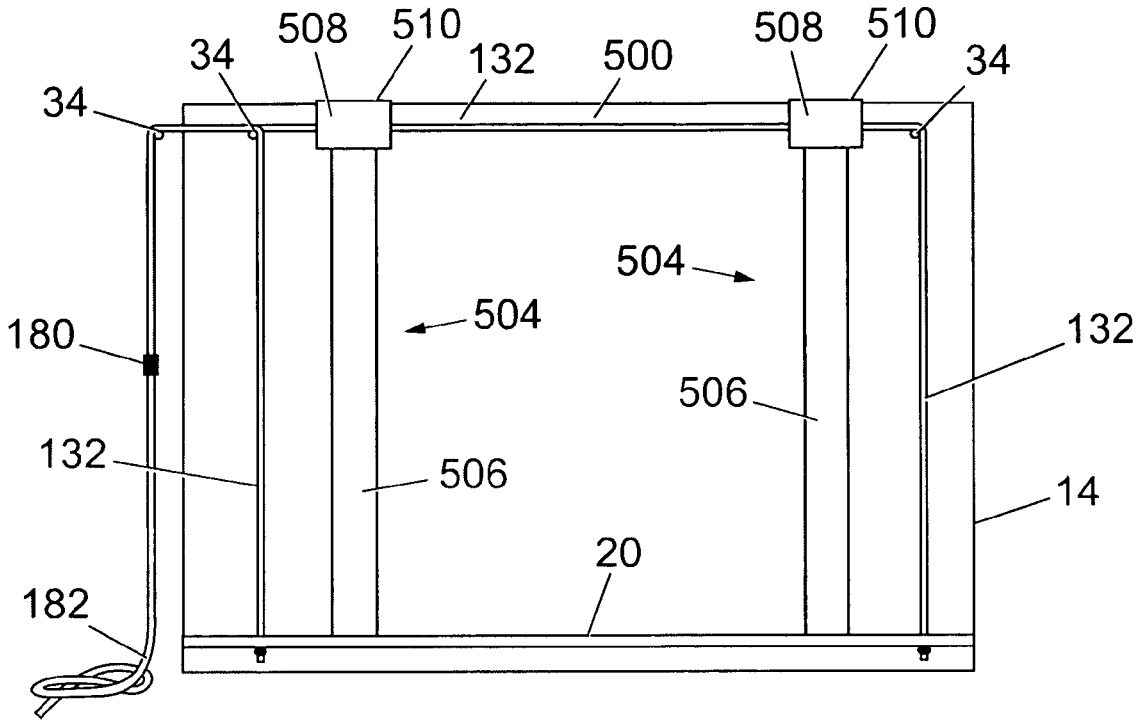
FIG. 17 shows a front elevation of a further embodiment of a sign installation apparatus of the invention, which is similar to the FIG. 10 embodiment.

FIG. 17 shows a sign installation apparatus with an alternative lifting system 500. Most components of the apparatus are the same as those in the embodiment of FIG. 10, and are not described further. The lifting system 500 comprises one or more cords 132, which are attached to the top rail 20 (at both ends) and which pass over pulleys 34 on the support structure 14.

The cords 132 extend through apertures in the top rail 20, and are knotted or otherwise clamped underneath the top rail 20. The system of cords 132 and pulleys 34 may alternatively comprise other configurations, such as those shown in FIGS. 1 and 2.

The cords 132 are connected together by a clamp 180, below which may be a single cord 182. In an alternative embodiment, the cords 132 could continue as two separate cords.

The FIG. 17 embodiment differs from the FIG. 10 embodiment by its use of one or more springs assemblies 504 to bias the top rail 20 into its raised position. In FIG. 17, two spring assemblies 504 are used. Typically, the use of these spring assemblies 504 makes the counterweight W of FIG. 10 redundant, although in some embodiments, both the counterweight W and one or more spring assemblies 504 could be used.

Figure 18:
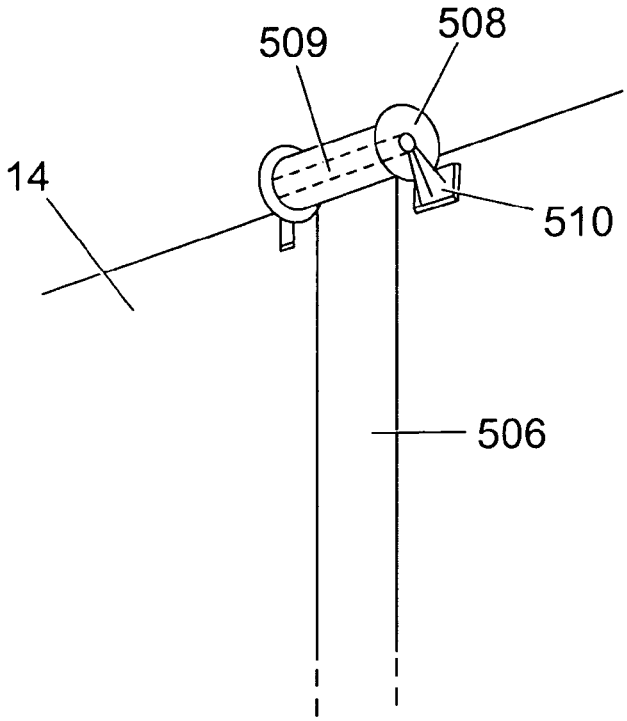
FIG. 18 shows a perspective view of a spring assembly of the FIG. 17 embodiment.

The spring assembly 504 is shown in FIG. 18 and comprises a tape 506 which is wound around a spool 508. The spool 508 is rotatably mounted on a shaft 509 of a mount 510. The mount 510 is attached to an upper part of the support structure 14, typically along the upper edge, as shown in FIG. 17. The radially innermost end of the tape 506 is fixed to the spool 508. The radially outermost end of the tape 506 is fixed (e.g. nailed, bolted, screwed) to the top rail 20. The spool 508 is biased (with respect to the shaft 509) by a coil spring or similar (not shown), so that the spring force acts to counterbalance the weight of the top rail 20.

FIG. 17 shows the sign installation apparatus with its lifting system 500 in a lowered mounting position. A large proportion of the tapes 506 have unrolled from their respective spools 508. Each tape 506 is forced into a substantially flat configuration, extending vertically downwards from the spool 508 to the top rail 20 (in its lowered position). Gravity holds the top rail 20 in the lowered position, against the bias of the springs (not shown), which exert an upwards force on the top rail 20.

To raise the top rail 20 into its raised position, the cord 182 is pulled. The cords 132 pass over the pulley 34 and pull the top rail 20 upwards, assisted by the spring assemblies 504. The spring (not shown) of each spring assembly 504 winds up, which causes the shaft 509 to rotate, which wraps the tape 506 around the spool 508, reducing the extended length of tape 506, and raising the top rail 20.

Hence, the amount of force required to lift the top rail 20 to its raised position is substantially reduced, as there is already a biasing force from the spring assemblies 504 acting on the top rail 20 in an upwards direction. In use, the spring assemblies 504 also hold a mounted advertising sign under tension. Embodiments according to FIGS. 17 and 18 can be less expensive and can be easier to install.

An advertising sign is installed on the apparatus or billboard of FIG. 1 as follows.

An operative arrives on site with an advertising sign 12 provided with pockets 70 at the top and bottom edges. The sign 12 may be folded or rolled. If the apparatus is provided with a fold-down panel 60, **60*a* which may be used as a work surface, the operative folds this down after unlocking any necessary retaining means or cover plates. The advertising sign 12 may be placed within the bottom frame 22** to protect it during windy conditions.

If the top rail 30 is not already in the lowered mounting position shown in FIG. 1, the operative pulls the cord 32 of the lifting system 16 to lower the top rail 30 to the lowered mounting position. The operative takes a semi-rigid cord 74, which may have been removed from a sign 12 previously taken down at the same site, and threads it though the top pocket 70 in the sign 12, to form a top flange. He then threads the top flange into a longitudinally extending channel 58 on the top rail 30. This can be done either by detaching the top channel member 52 from the top support member 54 and threading the top channel member 52 over the top flange before reattaching the top channel member 52 to the top support member 54, or by threading the top flange directly into the top channel member 52 on the top rail 30.

The operative then pulls the cord 32, 132 of the lifting system 16 to raise the top rail 30 to the raised display position, or to a raised position close to this. The cord 32, 132 of the lifting system 16 can be clamped in a cleat 184 such as that shown in FIG. 10 or tied to hold the top rail in this position. The sign 12 then hangs from the top rail, and the operative threads a second semi-rigid cord 74, which also may have been removed from a sign 12 previously taken down at the same site, and threads it though the bottom pocket 70 in the sign 12, to form a bottom flange. The bottom channel member 42 is then detached from the bottom support member 44 and threaded over the bottom flange so that the weight of the bottom channel member 42 pulls the sign down.

If the top rail 30 is not already in its final display position, the operative then pulls the cord 32, 132 of the lifting system 16 to further raise the top rail 30 to the raised display position. The cord 32, 132 of the lifting system 16 can be clamped in a cleat or other suitable device (not shown) to hold the top rail in its raised display position. Because the cord 32, 132 is arranged in a parallel linkage mechanism, the top rail 30 remains horizontal even though the operative only pulls and clamps the cord 32, 132 on one side of the apparatus. The operative then pulls the bottom channel member 42 down to pull the sign tight, and engages the bottom channel member 42 to the bottom support member 44 by the DualLock™, or other mutual engagement means, so that the bottom channel member 42 is fixed to the support structure 14.

A top frame member 20 projects in front of the top rail 30 so that it conceals the top rail 30 in the raised display position. Once the sign has been mounted the bottom frame cover 60, **60*a* of the bottom frame member 22 is folded back up to conceal the bottom channel member 42. The side frame members 24 project in front of the lateral edges of the sign 12** to conceal these.

One or both of the side frame members 24 may include an opening or a hinged or removable cover (not shown) to provide access to the rear of the advertising sign to operate the lifting system. In the embodiment of FIGS. 1 and 2 the operative can reach behind the sign 12 to pull the vertical cord 32 of the lifting system to raise or lower the top rail 30. In the embodiment of FIG. 10 the operative can gain access to the cords 132, 182 at the side of the support structure 14.

If and when the sign 12 needs to be taken down and replaced with an alternative sign (e.g. with a different advertisement thereon), the above steps can be reversed—i.e. the cover 60, 60*a* is opened, the bottom rail member 42 is peeled away to separate the mutually engaging fasteners or Dual-Lock™, the bottom rail member 42 is pulled off the bottom flange of the sign 12, the top rail 30 is lowered, and the top flange of the sign 12 is pulled out of the top rail 30. The semi-rigid cords 74 can be removed for reuse. The guide members 92, 100 at the side of the sign, if used, can also be removed.

The sign 12 can now be taken away and the entire sign 12 can now be sent for recycling. A new sign 12 is then mounted on the apparatus 10, as described above.

If required, the sign can be front lit (e.g. a halogen light in front of the sign), and/or backlit (e.g. by fluorescent tubes located between the support structure 14 and the sign 12.

The operation of the embodiment of FIGS. 17 and 18 is the same as described above in respect of the embodiments of FIGS. 1 to 9 and 10 to 12.

It should be noted that the sign 12 does not include any clips, edge strips or other "finishing means". The only thing that needs to be done to the sign 12 to prepare for mounting is to form the pockets 70 on the top and bottom edges and, optionally, attach guide members 92, 100 to the side edges. Hence the sign 12 is inexpensive and simple to produce.

As noted above, the sign 12 can consist entirely of polyethylene, so that it can be 100% recycled. This is beneficial for the environment. There is no need to first remove any added "finishing means", e.g. clips, edge strips.

A further advantage of the invention is that all steps to mount the sign 12 can be taken by a single person, who does not leave the ground. There is no standing on ladders to attach an upper part of the sign to the top of the support. Hence, the sign is not only quick and easy to install, but health and safety risks for the personnel involved are reduced. In particular, the person installing the sign 12 does not have to comply with Health and Safety Guidelines governing working above 2.5 meters.

Likewise, the sign 12 is very easy to dismount and replace, and this can also be done by a single person, who does not leave the ground.

When employing the apparatus of the alternative embodiment illustrated in FIGS. 13-16, an advertising sign is installed on the apparatus or billboard of FIG. 1 as follows.

An operative arrives on site with an advertising sign 112 either rolled or folded horizontally with the top of the advertising sign 112 exposed on its outside edge. Other than optional printed indicia on the advertising sign 112 to assist in the placement of insert members 300 (as described below), the sign 112 requires no modification or "finishing" prior to its installation. If the apparatus is provided with a fold-down panel 60, 60*a* which may be used as a work surface, the operative folds this down after unlocking any necessary retaining means or cover plates.

If the top rail 30 is not already in the lowered mounting position as shown in FIG. 1, the operative pulls the cord 32 of the lifting system 16 to lower the top rail 30 to the lowered mounting position near the fold-down panel 60, 60*a* (if present). The operative un-rolls or unfolds enough of the advertising sign 112 such that a central portion of its upper peripheral edge extends beyond a longitudinally extending channel 252 on the top rail 30. If present, the printed markings provided on the periphery of the sign 112 are used to properly align the upper peripheral region with longitudinally extending channel 252 thereby ensuring the installed sign 112 is horizontal. It will be appreciated that the word periphery is used to denote the region of the advertising sign 112 at or near its respective edges which is normally concealed from view behind frame members 20, 22 described below.

The operative then inserts a relatively short longitudinally extending insert member 300 into a central portion of the longitudinally extending channel 252 to thereby frictionally engage the sign 112 between the channel 252 and the insert 300 respectively. Again, if present, printed markings on the periphery of the sign 112 are used to ensure that the first short insert member 300 is positioned centrally. The operative then progressively inserts further insert members 300 on alternate sides of the central insert member 300 using the printed markings (if present) as a guide until the entire upper periphery of the sign 112 is engaged within the longitudinally extending channel 252. The longer the insert member 300, the more difficult it is to properly tension and align the sign 112 and so insert members 300 of appropriate lengths are selected to overcome this difficulty. An alternative method may involve firstly positioning three shorter insert members 300 at a central position, and both distal ends of each channel 252, (using the printed markings as a guide if they are present), and then filling in the gaps between the central insert member 300 with further insert members 300 which may be longer than the first three insert members 300.

Conveniently, the snap-fit arrangement of each insert member 300 within the channel member 252 avoids the need to thread the sign 112 into engagement with the top rail 30. There is therefore no need to detach the top channel member 252 from the top rail 30 during installation or removal and lateral clearance at the side of a billboard is no longer required.

It will be appreciated from FIG. 15 that the arrangement of the insert member 300 within the channel 252 acts to resist any downward forces applied to the sign 112. This is important to ensure that an operative may apply a downward tensioning force to the advertising sign 112 during installation without the sign 112 detaching from the top rail 30.

Downward forces applied to the sign 112 cause the insert member 300 to tend to rotate counter-clockwise about a pivot point 352*f* on the barb 352*e*. As the counter-clockwise rotation commences:

(i) the vertical face of the barb 352*e* pivots away from the inner vertical face of the detent 270;

(ii) the base of the recessed portion 370 pivots toward the inclined surface 270*a* of the detent 270; and (iii) the side flange 360*a* pivots toward the exterior surface of the detent 270.

The absolute limit of the counter-clockwise rotation is dictated by the angle of the inclined surface 270*a* and/or the length of the side flange 360*a* and its clearance from the exterior surface of the detent 270. As soon as any counter-rotation of the insert member 300 occurs, a pinching action is created at the pivot point 352*f* such that the insert member 300 tightens its engagement with the interposed sign 112. The engagement force between the side walls 252*c*, 352*c*, and between the side flange 360*a* and the exterior surface of the detent 270 may also increase.

Conversely, a sufficient upward force applied to the sign 112 causes the kink caused by the presence of the barb 352*e* and the detent 270 to attempt to straighten out along the upper side wall 352*b* of the insert member 300. The resultant downward force applied to the barb 352*e* causes the side wall 352*b* to pivot clockwise towards the opposing side wall 352*c* until the upper end of the barb 352*e* disengages from behind the detent 270, thereby releasing the insert member 300 and the sign 112 from the channel 252.

Once the top peripheral region of the sign 112 is engaged, the operative then pulls the cord 32, 132 of the lifting system 16 to raise the top rail 30 to the raised display position. The raising of the top rail 30 may optionally be done in stages to allow side clips attached to a side tensioning wire or cord to be connected to selected positions on the peripheral lateral sides of the sign 112. Printed markings may be provided near the lateral edges of the sign 112 to ensure the operative connects the clips in the proper locations. The cord 32, 132 of the lifting system 16 can be clamped in a cleat 184 such as that shown in FIG. 10 or tied to hold the top rail in this position. The sign 112 then hangs from the top rail 30 and is restrained against flapping in the wind due to the presence of the side clips.

The operative may then repeat the aforementioned steps by engaging the lower edge of the sign 112 between another channel member 452 and insert member 300 provided on the lower part of the support structure 14. Starting at a central portion of the sign 112, the operative manually tensions the sign 112 by exerting a downward force until the printed markings (if present) on its peripheral region align with the lower channel member 452. The operative then inserts a relatively short longitudinally extending insert member 300 into a central portion of the lower channel 452 to thereby frictionally engage the sign 112 between the channel 452 and the insert 300 respectively. The operative then progressively inserts further insert members 300 on alternate sides of the central insert member 300 in equal stages using the printed markings (if present) as a guide until the entire lower periphery of the sign 112 is engaged within the lower channel 452. As each insert member 300 is inserted, the operative manually tensions the sign 112 to ensure the printed markings (if present) are properly aligned such that the sign 112 is horizontal.

In converse to the situation in FIG. 15 regarding the top channel member 252, because the orientation of the bottom channel member 452 and its insert 300 are reversed, the action of forces applied to the sign 112 will also be reversed.

Therefore, in FIG. 16, the arrangement of the insert member 300 within the bottom channel member 452 acts to resist any upward forces applied to the sign 112. This ensures that the advertising sign 112 will not detach from the bottom rail during installation, despite the sign 112 being under tension (specifically, the lower edge of the sign 112 experiences an upwards tensioning force). However, applying a sufficient downwards force to the sign 112 causes the kink caused by the presence of the barb 352*e* and the detent 470 to attempt to straighten out, thereby releasing the insert member 300 and the sign 112 from the bottom channel member 452.

The cord 32, 132 of the lifting system 16 can be clamped in a cleat or other suitable device (not shown) to hold the top rail in its raised display position. Because the cord 32, 132 is arranged in a parallel linkage mechanism, the top rail 30 remains horizontal even though the operative only pulls and clamps the cord 32, 132 on one side of the apparatus.

A top frame member 20 projects in front of the top rail 30 so that it conceals the top rail 30 in the raised display position. Once the sign 112 has been mounted the bottom hinged cover 460 of the bottom frame member 422 is folded back up (and typically locked) to conceal the bottom channel member 452. The side frame members 24 project in front of the lateral edges of the sign 112 12 to conceal these.

If and when the sign 112 needs to be taken down and replaced with an alternative sign (e.g. with a different advertisement thereon), the above steps can be reversed.

The apparatus of the alternative embodiment described above allows the posting of advertising signs which require no adaptation or "finishing" of their peripheral regions prior to installation. Accordingly, media owners can employ regular printers to print their signs thus avoiding costs associated with bespoke printing and finishing of a sign. Again, the operative can work safely from ground level at all times without the need for ladders, telescopic poles or other specialised tools. Given that the sign 112 connects to the top rail 30 within a few inches of being unrolled or unfolded, neither the sign 112 nor the apparatus is adversely affected during windy weather conditions. The sign can therefore be installed and removed very quickly in a controlled manner regardless of weather conditions.

Modifications and improvements may be incorporated without departing from the scope of the invention. For example, each top channel member 52, 252 is not necessarily a separate component from the top support member 54, and may alternatively be formed integrally therewith. Hence, in such an embodiment, the mutual engagement means 56 may be omitted.

Although the channel members 42, 52 and support members 44, 54 are shown as hollow box sections, they can take any suitable shape, for example solid sections or bars.

Although the channels and insert members are preferably formed by extrusion, they may equally be formed by injection moulding.

Although the insert member 300 shown in FIGS. 13-16 is shown as a separate component which is independent of the channel members 252, 452, the respective members 300, 252; 300, 452 may be permanently linked together by means of a cord, and end hinge or any other suitable means thereby ensuring that the insert member 300 is not misplaced and is always conveniently located ready for insertion within its respective channel member 252, 452.

Alternatively, one or more insert members may be joined to its respective channel member 252, 452 by means of a hinge arrangement running longitudinally along the length of the channel member 252, 452. In this way, an operative need only pivot the or each insert member 300 into a snap-fit engagement with the channel member 252, 452. By providing a plurality of insert members 300 along the length of the channel 252, 452 the operative can progressively tension and attach a sign 112 as described above.

The lifting system 16,116 may comprise two cords 32, 132 fixed to the top rail 20, 30 at or near each end of the top rail 20, 30, each extending from the top rail 20, 30 to the top of the support structure, down one side of the support structure and fixed to a common counterweight via a double pulley block. The double pulley block causes the top rail 20, 30 to move two units of length for every unit of length moved by the counterweight.

Some or all of the frame members 20, 22, 24 may be omitted. Additional sign support means may be provided, for example clamps or fixings at the lateral edges of the support structure 14 to support the lateral edges of the advertising sign 12 when it is in the raised display position. A substrate may be installed on the support structure 14 to act as a sandwich layer between the support structure 14 and the advertising sign 12. This may be sufficiently thick to deflect the advertising sign 12 away from the support structure 14, so that advertising sign is supported at intermediate positions to prevent flapping in high wind. The substrate may be provided in discrete areas on the support structure 14. The substrate may be spaced from the support structure 14 by spacers so that at least part of the lifting system 16 is located between the substrate and the support structure 14.

In an alternative embodiment the sign 12 comprises polyethylene but does not consist solely of polyethylene. In other embodiments, the sign can be paper, toughened paper, laminated paper, fabric, a woven fabric mesh, or made from any other suitable material. In some embodiments, part of the sign could be rigid whereas other parts could be flexible.

The components which are formed of uPVC could alternatively be formed of PVC or any other suitable plastic (or other) material.

In an alternative embodiment, the side attachment means of FIGS. 11 and 12 could be replaced by a channel member and insert system, for example, as described for the top and bottom rails with reference to FIGS. 13 to 16. Hence, in some embodiments, a channel member and insert clamping system can be used on all four edges of the advertising sign 12.

The invention claimed is:

1. An apparatus for installing an advertising sign comprising:

a support structure;

a lifting system fixed to the support structure;

a top rail supported on the lifting system such that the top rail can be raised and lowered between a lowered mounting position and a raised display position; and a bottom rail fixed to the support structure;

wherein the lifting system comprises a cord operable to raise the top rail to the upper display position;

wherein the top rail comprises a longitudinally extending channel adapted to engage a top periphery of an advertising sign; and wherein the bottom rail comprises a longitudinally extending channel adapted to engage a bottom periphery of an advertising sign;

wherein said cord is supported by a support member on the support structure, the support being selected from the group consisting of sliding supports and rollers, said cord directed up about said support from said top rail and then down past said top rail and toward said bottom rail.

2. An apparatus as claimed in claim 1, wherein the bottom rail comprises a bottom support member fixed to the support structure and a bottom channel member which comprises the longitudinally extending channel adapted to engage the bottom periphery of an advertising sign; and wherein the bottom channel member is releasably attached to the bottom support member by a mutual engagement system.

3. An apparatus as claimed in claim 2, wherein the mutual engagement system comprises mutually engaging mushroom fasteners provided on each of the bottom support member and the bottom channel member.

4. An apparatus as claimed in claim 1, wherein the top rail comprises a top support member supported on the lifting system and a top channel member which comprises the longitudinally extending channel adapted to engage the top periphery of an advertising sign; and wherein the top channel member is releasably attached to the top support member by a mutual engagement system.

5. An apparatus as claimed in claim 4, wherein the mutual engagement system comprises mutually engaging mushroom fasteners provided on each of the top support member and the top channel member.

6. An apparatus as claimed in claim 1, also comprising a longitudinally extending insert member releasably engageable within at least one of the longitudinally extending channels of the top and bottom rails.

7. An apparatus as claimed in claim 6, wherein the insert member forms part of a periphery of an advertising sign to be installed.

8. An apparatus as claimed in claim 6, wherein the insert member is independent of an advertising sign to be installed and is adapted such that, upon its insertion into the channel, it releasably engages with the channel.

9. An apparatus as claimed in claim 6, wherein the channel and the insert member are respectively provided with interengageable formations adapted such that the insert member is releasably engageable within the channel by means of a snap-fit arrangement.

10. An apparatus as claimed in claim 9, wherein at least one property of the insert member is selected such that the insert member is relatively more resiliently deformable than the channel, to facilitate the snap-fit arrangement, the at least one property being selected from the group consisting of: the shape of the insert member; the dimensions of the insert member; and the material from which the insert member is formed.

11. An apparatus as claimed in claim 6, wherein each channel is generally U-shaped in cross-section and comprises two side walls which together define a channel opening, and wherein one of the side walls is provided with a detent extending inwardly into the channel opening in a direction towards the other side wall.

12. An apparatus as claimed in claim 11, wherein the insert member is generally U-shaped in cross-section and comprises two side walls, one of which is inclined relative to the other.

13. An apparatus as claimed in claim 12, wherein the inclined side wall is provided with an outwardly extending barb, adapted to engage behind the inwardly extending detent of the channel.

14. An apparatus as claimed in claim 1, wherein the lifting system comprises a parallel linkage mechanism which holds the top rail in a horizontal position during raising and lowering.

15. An apparatus as claimed in claim 1, wherein the lifting system comprises two cords fixed to the top rail in the vicinity of each end of the top rail and wherein each cord extends from the top rail to the top of the support structure and down one side of the support structure, such that pulling the cords downwards at the side of the structure causes the top rail to be raised.

16. An apparatus as claimed in claim 1, wherein the cord is arranged in a sideways figure of eight arrangement on the support structure, such that raising the cord at one side of the support structure causes the cord to be raised at the other side of the support structure.

17. An apparatus as claimed in claim 1, wherein the lifting system includes a counterweight adapted to move downwards as the top rail is raised.

18. An apparatus as claimed in claim 1, wherein the top rail is spring biased towards its raised display position.

19. An apparatus as claimed in claim 1, wherein the lifting system comprises two cords fixed to the top rail in the vicinity of each end of the top rail, each extending from the top rail to the top of the support structure, through a double pulley block, and down one side of the support structure and fixed to a common counterweight.

20. An apparatus as claimed in claim 1, further including side guide rails to which the sign may be connected by guide members or clips.

21. A system for installing an advertising sign comprising an apparatus as claimed in claim 1 and an advertising sign.

22. A system as claimed in claim 21, wherein the advertising sign comprises a flexible, printable sheet of material.

23. A system as claimed in claim 21, wherein at least one of the longitudinally extending channels of the top and bottom rails is adapted to engage a flange provided on the periphery of the advertising sign.

24. A system as claimed in claim 23, wherein the advertising sign has longitudinally extending pockets provided on the top and bottom edges thereof, and wherein the system also comprises at least one semi-rigid cord member which is threaded into one of the pockets to form a flange in the advertising sign.

25. A system as claimed in claim 23, wherein the advertising sign requires no peripheral finishing to facilitate its engagement with the longitudinally extending channels.

26. A method for installing an advertising sign comprising the steps of:

providing a support structure;

providing a lifting system fixed to the support structure;

lowering a top rail supported on the lifting system on a support to a lowered mounting position;

engaging a longitudinally extending channel of the top rail with a top periphery of an advertising sign;

using the lifting system to raise the top rail to a raised display position;

engaging a longitudinally extending channel of a bottom rail of the support structure with a bottom periphery of the advertising sign; and raising said top rail with at least one cord of said lifting system by connecting said cord to said top rail, drawing said cord upwardly along said support structure and then over said support and drawing said cord downwardly along said support structure as said top rail is raised.

27. A method as claimed in claim 26, wherein the steps of engaging the longitudinally extending channels involve threading a second respective semi-rigid cord member into respective pockets provided on the top and bottom peripheral edges of the advertising sign to form respective top and bottom flanges in the advertising sign and then threading the top and bottom flanges into the longitudinally extending channels on the respective top and bottom rails.

28. A method as claimed in claim 26, wherein at least one of the top and the bottom channels are secured to the support structure by attaching that channel to a corresponding support member fixed to the support structure using a releasable mutual engagement system.

* * * * *